US008577737B1

(12) United States Patent
Amacker et al.

(10) Patent No.: US 8,577,737 B1
(45) Date of Patent: Nov. 5, 2013

(54) METHOD, MEDIUM, AND SYSTEM FOR APPLICATION LENDING

(75) Inventors: Matthew W. Amacker, Santa Clara, CA (US); Stephen S. Tompkins, San Jose, CA (US)

(73) Assignee: A9.com, Inc., Palo Alto, CA (US)

( * ) Notice: Subject to any disclaimer, the term of this patent is extended or adjusted under 35 U.S.C. 154(b) by 333 days.

(21) Appl. No.: 13/164,655

(22) Filed: Jun. 20, 2011

(51) Int. Cl.
*G06Q 30/00* (2012.01)

(52) U.S. Cl.
USPC ..... 705/26.1

(58) Field of Classification Search
USPC ..... 705/26.1, 27.1
See application file for complete search history.

(56) References Cited

U.S. PATENT DOCUMENTS 6,119,229 A * 9/2000 Martinez et al. ..... 726/28
2006/0234795 A1* 10/2006 Dhunjishaw et al. ..... 463/42
2008/0039166 A1* 2/2008 Harris et al. ..... 463/8
2010/0325022 A9* 12/2010 Ben-Yaacov et al. ..... 705/30
2011/0302058 A1* 12/2011 Hashiura et al. ..... 705/27.1
2011/0313892 A1* 12/2011 Dicke et al. ..... 705/27.2

OTHER PUBLICATIONS

Stini, Michael, Martin Mauve, and Frank HP Fitzek. "Digital ownership: From content consumers to owners and traders." MultiMedia, IEEE 13.4 (2006): 1-6.*

* cited by examiner

*Primary Examiner* — Matthew Zimmerman
(74) *Attorney, Agent, or Firm* — Novak Druce Connolly Bove + Quigg LLP

(57) ABSTRACT

Disclosed herein are techniques, including systems and methods, for enabling a lending user to lend an application to a borrowing user. The borrowing user may use the application for a trial period, and, once the trial period lapses, the borrowing user may be given an opportunity to purchase the application. If the borrowing user purchases the application, then the lending user may be credited with a commission. According to some embodiments, in addition to or instead of lending the application, the lending user may lend or sell a status/stake in the application to the borrowing user. For example, if the application is a game, the status/stake may unlock certain levels or features of the game.

24 Claims, 9 Drawing Sheets

METHOD, MEDIUM, AND SYSTEM FOR APPLICATION LENDING

BACKGROUND

Oftentimes consumers find out about new products through referrals from other consumers. For example, a consumer who enjoys using a new mobile application that was recently purchased for the mobile device may tell multiple friends about the application and recommend that those friends also buy the application. However, the consumer's friends may not purchase the application until they have had a chance to try out the application for themselves. Thus, for example, they may ask to borrow the consumer's mobile device so that they can try out the application and assess whether they like the application enough to purchase it. This may be undesirable or impracticable because the consumer may not want to lend out the mobile device, because use of the application involves personal data (e.g., personal banking data) that the consumer may not want to share with friends, because the consumer and the friends are in different locations, or because extensive usage time maybe required before a user can properly assess whether the user would enjoy using the application.

BRIEF DESCRIPTION OF THE DRAWINGS

Various embodiments in accordance with the present disclosure will be described with reference to the drawings, in which.

Same numbers are used throughout the disclosure and figures to reference like components and features, but such repetition of number is for purposes of simplicity of explanation and understanding, and should not be viewed as a limitation on the various embodiments.

DETAILED DESCRIPTION

Figure 1:
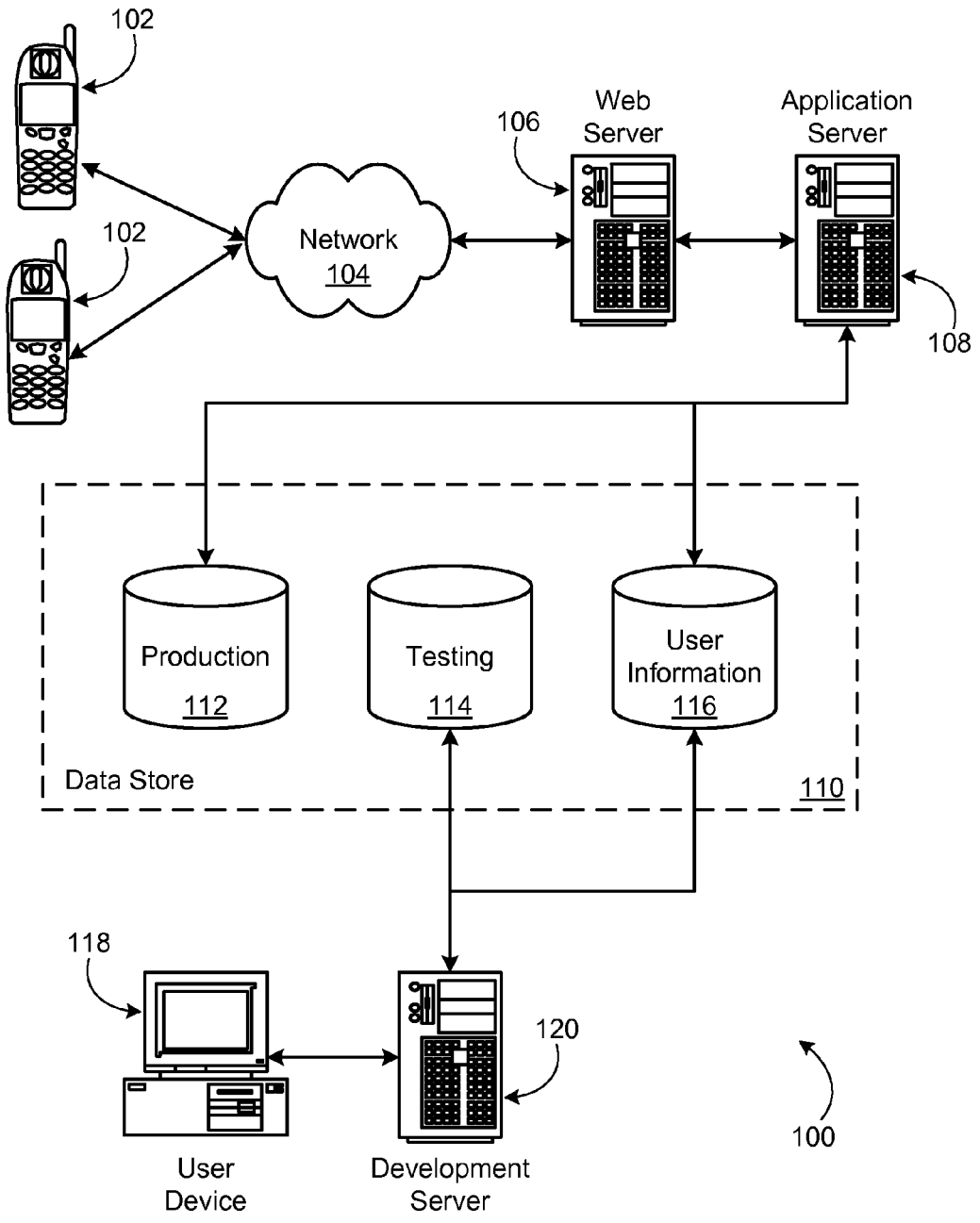
FIG. 1 is a schematic diagram illustrating an example environment for implementing aspects, in accordance with at least one embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details, and that variations and other aspects not explicitly disclosed herein are contemplated within the scope of the various embodiments. Furthermore, well-known features may be omitted or simplified in order not to obscure the embodiment being described.

Disclosed herein are techniques, including systems and methods, for enabling a lending user to lend an application, or other such content, to a borrowing user. For example, the borrowing user may use the application for a predetermined period of time, and, once the predetermined period of time lapses, the borrowing user may be given an opportunity to purchase the application. If the borrowing user purchases the application, the lending user may be credited with a referral commission. According to some embodiments, in addition to or instead of lending the application, the lending user may lend or sell that user's status or stake in the application to the borrowing user. For example, if the application is a game, the status may unlock certain levels or features of the game. According to this example, multiple users could collaboratively defeat a game. For example, a first user could advance to a first level and then sell their status to a second user who could then advance to a second level and then sell their status to a third user, and so on. The users that sell or lend their status as well as the application developer could receive a commission when status/sake is lent or sold.

It will be helpful to have a brief example of enabling a lending user to lend an application to a borrowing user. In one example, a first device receives a request to lend an application that is installed on the first device to a second device. Here, for example, a lending user is associated with the first device, and the lending user requests the first device to share the application with the second device, which is associated with a borrowing user. Upon the first device receiving the request to lend the application, the first device obtains identification information for second device. For example, the identification information could be a telephone number or email address associated with the second device.

The first device uses the identification information to send an application lending ("app-lend" or "lend") notification to the second device, where the app-lend notification indicates that the application is available for the second device to borrow. For example, the app-lend notification could cause the second device to display a popup that indicates that the lending user would like to lend the application to the borrowing user. If the borrowing user indicates interest by clicking or otherwise interacting with the popup, a second popup may be displayed on the second device. The second popup may provide a description of the application along with an indication of how long the borrowing user may borrow the application. If the borrowing user wants to borrow the application, the borrowing user may interact with the second popup in such a manner that causes the second device to send an acceptance notification and thereby cause the application to be downloaded to the second device. For example, the borrowing user's interaction could cause the second device to link to a download server and download the application.

According to an embodiment, the application is configured to stop executing on the second device upon the lapse of a trial period. After the trial period lapses, the borrowing user is prompted to purchase the application. If the borrowing user purchases the application, then the lending user is credited with a commission. Also, according to an embodiment, a limited version of the application is provided for the second device to borrow and, after the borrowing user uses the limited version for a trial period, the borrowing user is prompted to purchase a full version of the application. If the borrowing user purchases the full version of the application, then the lending user is credited with a commission.

Various approaches may be implemented in various environments for various applications. For example, FIG. 1 illustrates an example of an environment 100 for implementing aspects in accordance with various embodiments. As will be appreciated, although a Web-based environment may be utilized for purposes of explanation, different environments may be utilized, as appropriate, to implement various embodiments. The environment 100 shown includes both a testing or a development portion (or side) and a production portion. The production portion includes an electronic client device 102, which may include any appropriate device operable to send and receive requests, messages, or information over an appropriate network 104 and convey information back to a user of the device 102. Examples of such client devices include personal computers, cell phones, handheld messaging devices, laptop computers, set-top boxes, personal data assistants, electronic book readers, and the like.

The network 104 may include any appropriate network, including an intranet, the Internet, a cellular network, a local area network, a wide area network, a wireless data network, or any other such network or combination thereof. Components utilized for such a system may depend at least in part upon the type of network and/or environment selected. Protocols and components for communicating via such a network are well known and will not be discussed herein in detail. Communication over the network may be enabled by wired or wireless connections, and combinations thereof. In this example, the network 104 includes the Internet, as the environment includes a Web server 106 for receiving requests and serving content in response thereto, although for other networks an alternative device serving a similar purpose could be utilized as would be apparent to one of ordinary skill in the art.

The illustrative environment 100 includes at least one application server 108 and a data store 110. It should be understood that there may be several application servers, layers, or other elements, processes, or components, which may be chained or otherwise configured, which may interact to perform tasks such as obtaining data from an appropriate data store. As used herein the term "data store" refers to any device or combination of devices capable of storing, accessing, and/or retrieving data, which may include any combination and number of data servers, databases, data storage devices, and data storage media, in any standard, distributed, or clustered environment.

The application server 108 may include any appropriate hardware and software for integrating with the data store as needed to execute aspects of one or more applications for the client device 102, and may even handle a majority of the data access and business logic for an application. The application server 108 provides access control services in cooperation with the data store 110, and is able to generate content such as text, graphics, audio, and/or video to be transferred to the user, which may be served to the user by the Web server 106 in the form of HTML, XML, or another appropriate structured language in this example.

The handling of all requests and responses, as well as the delivery of content between the client device 102 and the application server 108, may be handled by the Web server 106. It should be understood that the Web and application servers 106, 108 are not required and are merely example components, as structured code discussed herein may be executed on any appropriate device or host machine as discussed elsewhere herein. Further, the environment 100 may be architected in such a way that a test automation framework may be provided as a service to which a user or application may subscribe. A test automation framework may be provided as an implementation of any of the various testing patterns discussed herein, although various other implementations may be utilized as well, as discussed or suggested herein.

The environment 100 may also include a development and/or testing side, which includes a user device 118 allowing a user such as a developer, data administrator, or tester to access the system. The user device 118 may be any appropriate device or machine, such as is described above with respect to the client device 102. The environment 100 may also include a development server 120, which functions similar to the application server 108 but typically runs code during development and testing before the code is deployed and executed on the production side and becomes accessible to outside users, for example. In some embodiments, an application server may function as a development server, and separate production and testing storage may not be utilized.

The data store 110 may include several separate data tables, databases, or other data storage mechanisms and media for storing data relating to a particular aspect. For example, the data store 110 illustrated includes mechanisms for storing production data 112 and user information 116, which may be utilized to serve content for the production side. The data store 110 also is shown to include a mechanism for storing testing data 114, which may be utilized with the user information for the testing side. It should be understood that there may be many other aspects that are stored in the data store 110, such as for page image information and access right information, which may be stored in any of the above listed mechanisms as appropriate or in additional mechanisms in the data store 110.

The data store 110 is operable, through logic associated therewith, to receive instructions from the application server 108 or development server 120, and obtain, update, or otherwise process data in response thereto. In one example, a user might submit a search request for a certain type of item. In this case, the data store 110 might access the user information 116 to verify the identity of the user, and may access the catalog detail information to obtain information about items of that type. The information then may be returned to the user, such as in a results listing on a Web page that the user is able to view via a browser on the user device 102. Information for a particular item of interest may be viewed in a dedicated page or window of the browser.

Each server typically will include an operating system that provides executable program instructions for the general administration and operation of that server, and typically will include a computer-readable medium storing instructions that, when executed by a processor of the server, allow the server to perform its intended functions. Suitable implementations for the operating system and general functionality of the servers are known or commercially available, and are readily implemented by persons having ordinary skill in the art, particularly in light of the disclosure herein.

The environment 100 in one embodiment is a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are illustrated in FIG. 1. Thus, the depiction of the environment 100 in FIG. 1 should be taken as being illustrative in nature, and not limiting to the scope of the disclosure.

Figure 2:
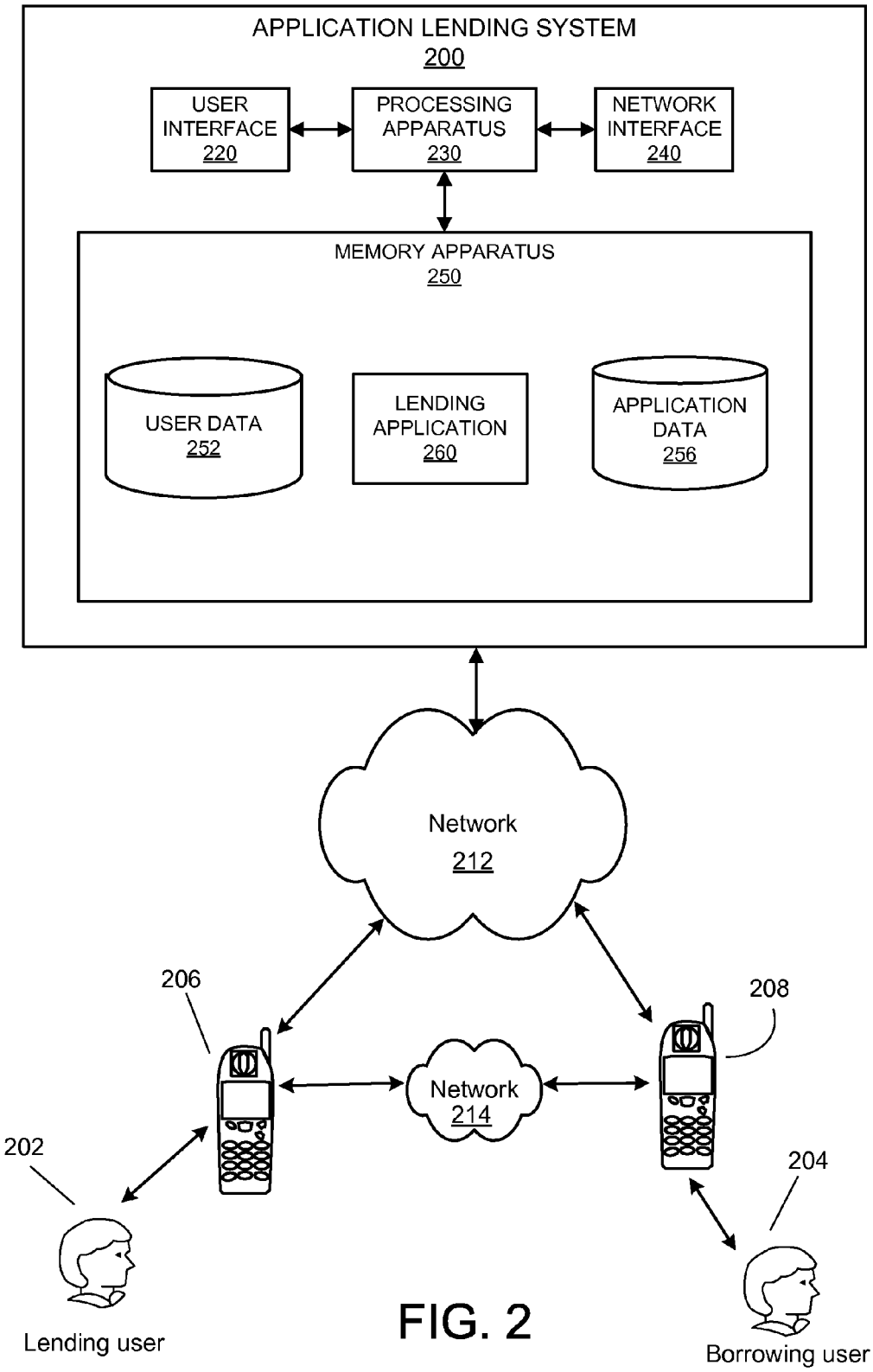
FIG. 2 is a block diagram depicting aspects of a system, in accordance with at least one embodiment.

It will be helpful to refer to an example system configured for enabling a lending user to lend an application to a borrowing user. FIG. 2 provides a block diagram of one such application lending system 200 configured to enable a lending user 202 to lend an application from a mobile device 206 to a mobile device 208 of a borrowing user 204. The application lending system 200 comprises a user-interface apparatus 220, a network-interface apparatus 240, and a memory apparatus 250 operatively coupled to a processing apparatus 230. The application lending system 200 may, in some embodiments, be integrated with other systems and environments, such as environment 100.

A network 212 connects the mobile devices 206 and 208 to each other and to the application lending system 200. Further, a network 214 interconnects the mobile devices 206 and 208. Although networks 212 and 214 are shown separately, it should be appreciated that they can be combined into a single network. Like network 104, networks 212 and 214 may include any appropriate network, including an intranet, the Internet, a cellular network, a local area network, a wide area network, a wireless data network, or any other such network or combination thereof. According to some embodiments, network 214 enables near field communications between the mobile devices 206 and 208. Such near field communications include short-range communications, such as RFID, Bluetooth™, infra-red, or other data transfer capability that can be used to exchange data between the mobile devices 206 and 208. Thus, the mobile devices 206 and 208 are capable of communicating and transferring data via cellular networks and near field communications, among others. As such, the lending user 202 and the borrowing user 204 may initiate a transaction by "bumping" the mobile devices 206 and 208. The "bump" transfers information via the network 214 about the application and about the offer to lend the application from the mobile device 206 of the lending user 202 to the mobile device 208 of the borrowing user 204. The mobile device 208 of the borrowing user 204 uses the information to contact the application lending system 200 and download the appropriate application via the network 212. It should also be appreciated that the lending user 202 and the borrowing user 204 may initiate a transaction by transferring initiating information via the network 212. In this case, the mobile device 206 may transfer the information via the network 212 directly to the mobile device 208, or the mobile device 206 may transfer the information to the system 200, which transfers the information to the mobile device 208.

As used herein, the term "apparatus" refers to a device or a combination of devices having the hardware and/or software configured to perform one or more specified functions. Therefore, an apparatus is not necessarily a single device and may, instead, include a plurality of devices that make up the apparatus. The plurality of devices may be directly coupled to one another or may be remote from one another, such as distributed over a network.

It will be understood by one of ordinary skill in the art in light of the present description that, although FIG. 2 illustrates the user interface 220, network interface 240, memory apparatus 250, and processing apparatus 230 as separate blocks in the block diagram, these separations may be merely conceptual. In other words, in some instances, the user interface 220, for example, is a separate and distinct device from the processing apparatus 230 and the memory apparatus 250 and therefore may have its own processor, memory, and software. In other instances, however, the user interface 220 is directly coupled to or integral with at least one part of the processing apparatus 230 and at least one part of the memory apparatus 250 and includes the user interface input and output hardware used by the processing apparatus 230 when the processing apparatus 230 executes user input and output software stored in the memory apparatus 250.

As will be described in greater detail below, in one embodiment, the application lending system 200 is entirely contained within a user terminal, such as a personal computer or mobile device, while, in other embodiments, the application lending system 200 includes a central computing system, one or more network servers, and one or more user terminals in communication with the central computing system via a network and the one or more network servers. For example, the application lending system 200 could be entirely contained in either or both of mobile devices 206, 208. FIG. 2 is intended to cover both types of configurations as well as other configurations that will be apparent to one of ordinary skill in the art in view of this disclosure.

The user interface 220 includes hardware and/or software for receiving input into the application lending system 200 from a user and hardware and/or software for communicating output from the application lending system 200 to a user. In some embodiments, the user interface 220 includes one or more user input devices, such as a keyboard, keypad, mouse, microphone, touch screen, touch pad, controller, and/or the like. In some embodiments, the user interface 220 includes one or more user output devices, such as a display (e.g., a monitor, liquid crystal display, one or more light emitting diodes, etc.), a speaker, a tactile output device, a printer, and/or other sensory devices that can be used to communicate information to a person.

In some embodiments, the network interface 240 is configured to receive electronic input from other devices in the network 104, including the client devices 102 and the data store 110. In some embodiments, the mobile devices 206, 208 are the client devices 102 of FIG. 1. Further, in some embodiments, the network interface 240 is further configured to send electronic output to other devices in a network.

The processing apparatus 230 includes circuitry used for implementing communication and logic functions of the application lending system 200. For example, the processing apparatus 230 may include a digital signal processor device, a microprocessor device, and various analog-to-digital converters, digital-to-analog converters, and other support circuits. Control and signal processing functions of the application lending system 200 are allocated between these devices according to their respective capabilities. The processing apparatus 230 may include functionality to operate one or more software programs based on computer-readable instructions thereof, which may be stored in the memory apparatus 250. As described in greater detail below, in one embodiment the memory apparatus 250 includes a lending application 260 stored therein for instructing the processing apparatus 230 to perform one or more operations of the procedures described herein and in reference to FIGS. 3, 6, and 9. Some embodiments may include other computer programs stored in the memory apparatus 250.

In general, the memory apparatus 250 is communicatively coupled to the processing apparatus 230 and includes at least one non-transitory computer-readable storage medium for storing computer-readable program code and instructions, as well as data stores containing data and/or databases. More particularly, the memory apparatus 250 may include volatile memory, such as volatile Random Access Memory (RAM) including a cache area for the temporary storage of data. The memory apparatus 250 may also include non-volatile memory that can be embedded and/or may be removable. The non-volatile memory can, for example, comprise an EEPROM, flash memory, or the like. The memory apparatus 250 can store any of a number of pieces of information and data used by the application lending system 200 to implement the functions of the application lending system 200 described herein.

In the illustrated embodiment, the memory apparatus 250 includes data stores containing user data 252 and application data 256. According to some embodiments, user data 252 includes, for example, information about users, such as lending user 202 and borrowing user 204. In some embodiments, the user data 252, for each individual user, provides information about the user's mobile device, such as the model and type of the device, the capabilities of the device, an email address associated with the device, and/or a telephone number associated with the device. Further, in some embodiments, the user data 252 includes information about which applications are owned by which users and which users have lent which applications to which users and the details of such lending transactions, such as the date the application was lent, whether the lending user also lent or sold lending user's status/stake in the application to the borrowing user, which level of access to the application was provided, the length of the trial period for the application, the date of expiration of trial period, etc.

Further, according to some embodiments, the user data 252 includes commission data for each individual user. For example, when a borrowing user purchases an application that was lent to that borrowing user by a lending user, the lending application 260 updates the user data 252 of the lending user with commission data, which includes the amount and type of commission to be granted to the lending user. According to some embodiments, a user may access the application lending system 200 via the user interface 220 and instruct the processing apparatus 230 to obtain the user's individual data 252 and then display the individual data 252. Further, according to some embodiments, a user may access the application lending system 200 via the user interface 220 and instruct the processing apparatus 230 to redeem the user's commissions.

According to some embodiments, the application data 256 includes downloadable copies of applications and/or information about where downloadable copies of applications are located, e.g., address information for download servers of the relevant application developers and distributors. In some embodiments, for each application, the application data 256 includes information about which versions (e.g., limited or full versions) of the application are available to be lent, the length of the trial period, whether lending users can lend or sell their stake/status in the applications, descriptions of the applications, costs of the applications, commissions to be paid to lending users when borrowing users purchase applications or purchase lending users' stake/status in an application, etc.

As discussed in more detail below, in some embodiments, linkages may be provided between the individual users of the user data 252 and the corresponding application data 256. Further, in some embodiments, user data 252 and/or application data 256 may be received from a user via the user interface 220, or may be obtained through electronic communication with another device, which may obtain the data from external data sources via the network 104 and then stored in the memory apparatus 250.

For the sake of clarity and ease of description, the figures provided herein generally illustrate the user data 252 and the application data 256 as each being separate from one another. However, it will be understood that, in some embodiments, these data stores may be combined or the data described as being stored within such data stores may be further separated into additional data stores. For example, the user data 252 may include the application data 256, or the application data 256 may include the user data 252.

In one embodiment, data within each of the data stores shown in FIG. 2 may be linked to, and thus organized around, a unique identification stored in the memory apparatus 250. In such case, unique identifications are assigned to each of the users and/or the users' devices. Thus, each identification is linked within the memory apparatus 250 to: (1) information relating to the individual user in the user data 252 and (2) application data relating to the individual user within the application data 256. The identifications may be input by the user via the user interface 220, and may be stored by the processing apparatus 230 in any of the data stores or in a separate data store within the memory apparatus 250. Furthermore, the user may create the linkages in the memory device 250 between the identifications and the data within the data stores utilizing the user interface 220.

As further illustrated by FIG. 2 and as briefly mentioned above, the memory apparatus 250 also includes the lending application 260. As used herein, the term "application" generally refers to computer-readable program code comprising computer-readable instructions and stored on a computer-readable storage medium, where the instructions instruct a processor to perform certain functions, such as logic functions, read and write functions, and/or the like. In this regard, the modeling application 260 includes computer-readable instructions for instructing the processing apparatus 230 and/or other devices to perform one or more of the functions described herein, such as one or more of the functions described in FIGS. 3, 6, and 9.

Figure 3:
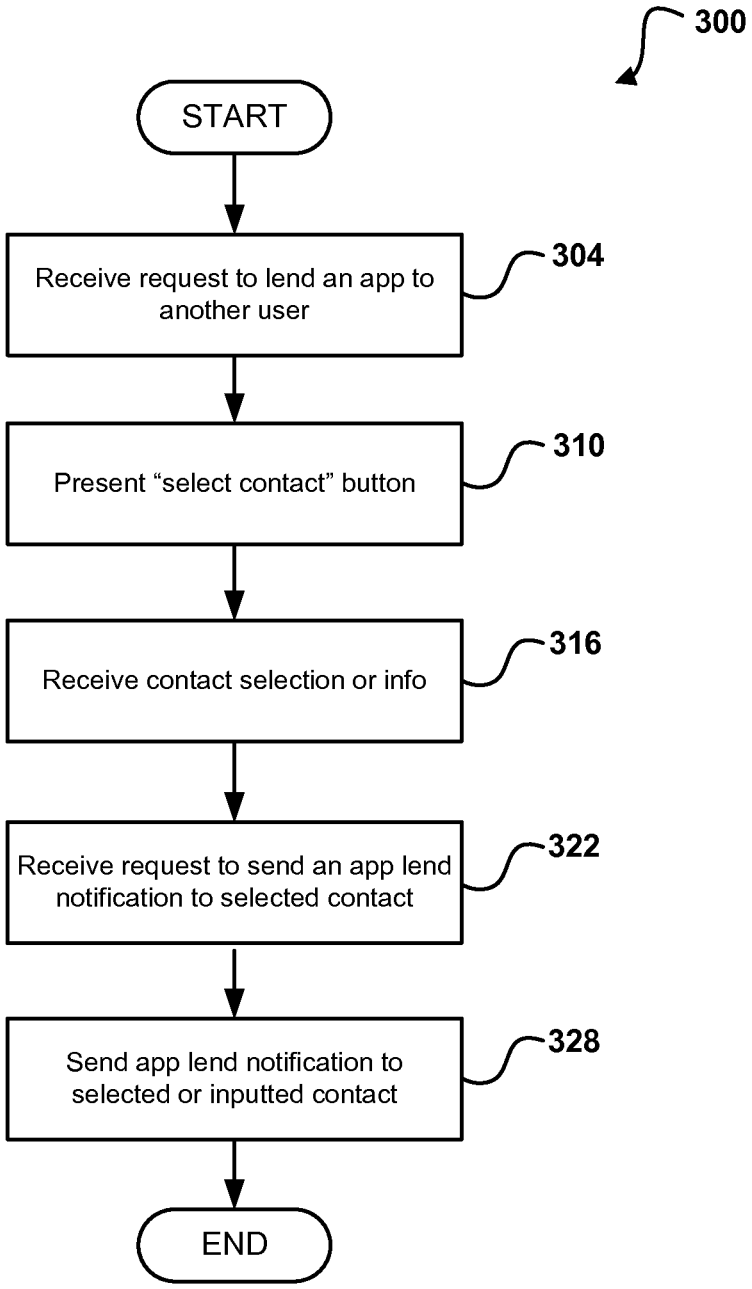
FIG. 3 provides a flow diagram illustrating an example process whereby an application lend notification ("app-lend notification" or "lend notification") is generated and sent, in accordance with at least one embodiment.
Figure 5:
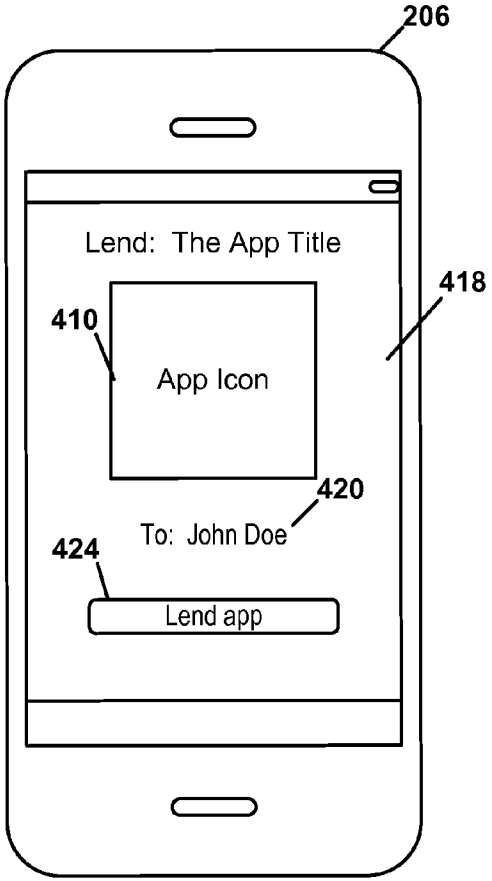
FIG. 5 is a schematic diagram illustrating an example user interface that prompts a user to lend an application to a selected contact, in accordance with at least one embodiment.
Figure 4:
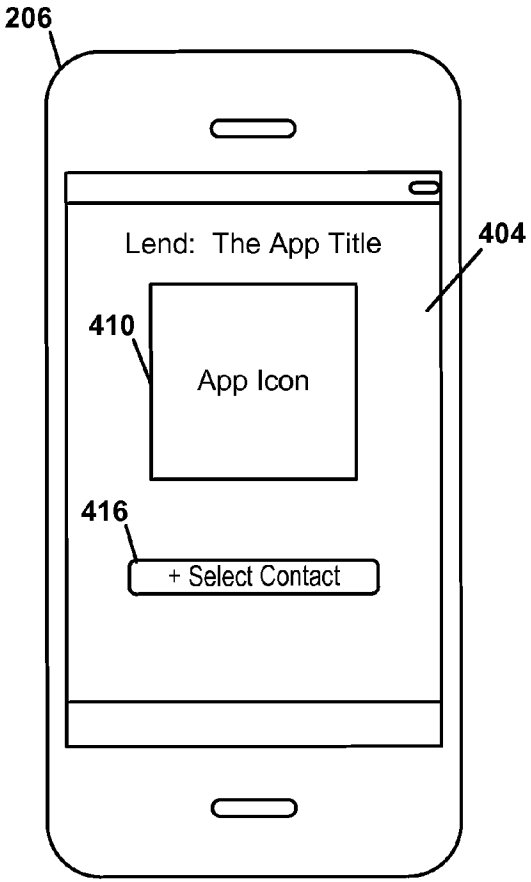
FIG. 4 is a schematic diagram illustrating an example user interface that prompts a user to select a contact to whom to lend an application, in accordance with at least one embodiment.

FIG. 3 provides a flow diagram illustrating an example process 300 whereby an app-lend notification is generated and sent, in accordance with at least one embodiment. According to an embodiment, the process 300 may be implemented on the mobile device 206 of the lending user 202. The process 300 will be described with reference to FIGS. 4 and 5. FIG. 4 is a schematic diagram illustrating an example user interface 404 that is displayed by the mobile device 206 and that prompts the lending user 202 to select a borrowing user 204 from a contacts list or to input information about a borrowing user 204 to whom to lend an application, in accordance with at least one embodiment. FIG. 5 is a schematic diagram illustrating an example user interface 418 that is displayed by the mobile device 206 and that prompts the lending user 202 to lend the application to the borrowing user 204, in accordance with at least one embodiment.

As indicated at 304, the process 300 generally begins by the mobile device 206 receiving a request from the lending user 202 to lend an application to the borrowing user 204. Upon receipt of the request, the mobile device 206 may provide the lending user 202 with an interface 404 that provides an application icon 410. The application icon 410 displays the icon associated with the application that is to be lent to the borrowing user. At 310, the process 300 involves presenting a "select contact" button 416 to the lending user 202. According to an embodiment, upon selection of the button 416, the mobile device 206 presents the lending user 202 with an address book or contact list from which the lending user may select a borrowing user. The address book or contact list may include, for example, an email address and/or a telephone number associated with the mobile device 208 of the borrowing user 204. It should be appreciated that user interface 418 of the mobile device 206 (FIG. 5) enables the lending user 202 to manually input contact information (e.g., telephone number, email address, etc) associated with the mobile device 208 of the borrowing user 204.

According to an embodiment, upon selection of the button 416, the mobile device 206 presents the lending user 202 with an option to use geographic location information to identify one or more potential borrowing users. If the lending user selects the option, the mobile device 206 sends a request to the application lending system 200 or some other suitable system to use geographic location information to identify other users who are located nearby. For example, the application lending system 200 may be configured to receive and/or access up-to-date geographic location data, e.g., geographic coordinates, from the mobile device 206 of the lending user 202 and from the mobile devices of other users. Upon receiving the request to identify one or more borrowing users, software running on the application lending system 200 compares the geographic location data of the lending user 202 to the geographic location data of the other users to identify one or more potential borrowing users 204 who are currently located near (e.g., within 100 feet) the lending user 202.

At 316, the process 300 involves receiving the contact selection or the inputted contact information. Here, the lending user 202 selects the borrowing user 204 from the address book/contact list or inputs contact information associated with the borrowing user 204. Once the contact information for the borrowing user 204 has been selected or inputted, the display name 420 of the borrowing user is displayed in the user interface 418.

As indicated at 322, the process 300 further involves the mobile device 206 receiving from the lending user 202 a request to send an app-lend notification to the borrowing user 204 whose contact information was previously selected or inputted. Here, as illustrated in FIG. 5, the user may select a "lend app" button 424 provided on the user interface 418 to request that the mobile device 206 send the app-lend notification. As indicated at 328, the app-lend notification is sent to the mobile device 208 of the borrowing user 204. According to an embodiment, the mobile device 206 of the lending user 202 sends the app-lend notification to the mobile device 208 of the borrowing user 204 via the network 214 using near field communications capability or short-range communications capability, such as RFID, Bluetooth™, infra-red, or other data transfer capability that can be used to exchange data between mobile devices. This type of data transfer is sometimes referred to as "bumping." According to other embodiments, the mobile device 206 of the lending user 202 sends the app-lend notification to the mobile device 208 of the borrowing user 204 via the network 212. For example, the app-lend notification may be sent in the form of an SMS message or any other suitable format via a cellular network. Also, for example, the mobile device 206 of the lending user 202 may send the app-lend notification to the mobile device 208 of the borrowing user 204 by way of the application sending system 200. For example, the mobile device 206 may send the app-lend notification to the application lending system 200, which processes and sends the app-lend notification to the mobile device 208 via the network 212.

Figure 6:
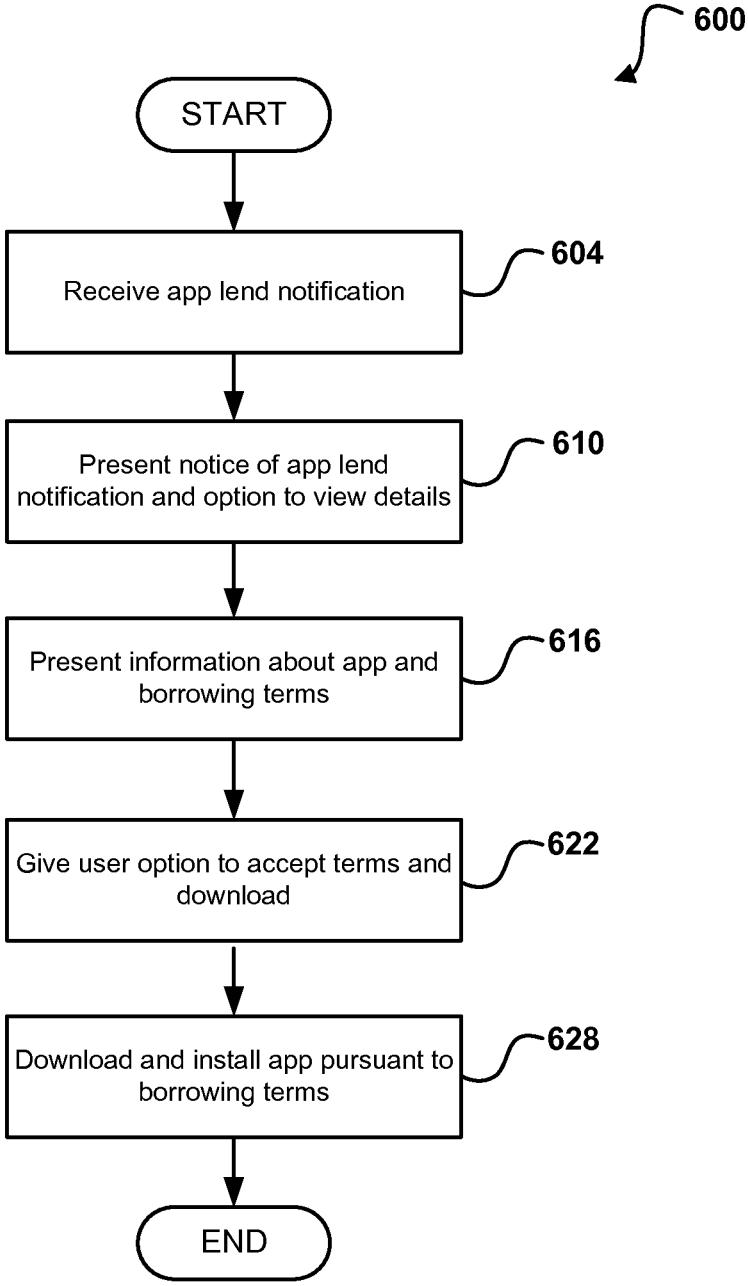
FIG. 6 provides a flow diagram illustrating an example process whereby an app-lend notification is received and an application is downloaded, in accordance with at least one embodiment.
Figure 8:
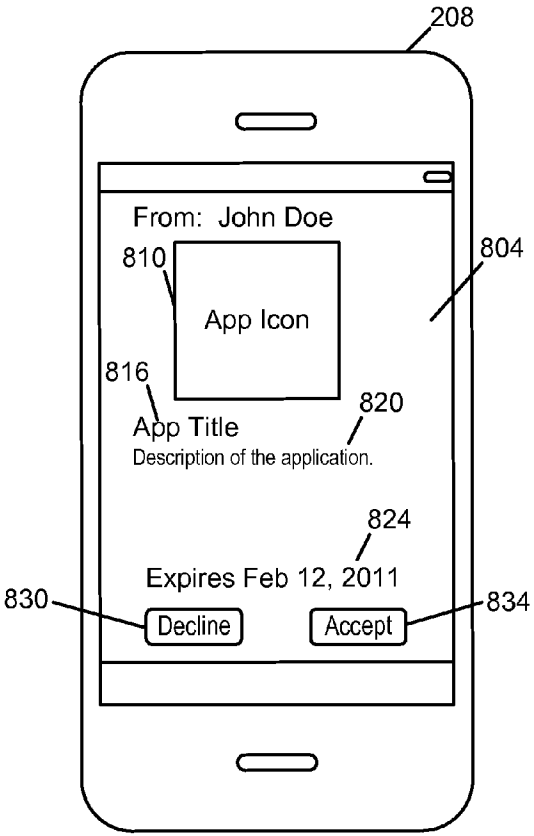
FIG. 8 is a schematic diagram illustrating an example user interface that prompts a user to accept or decline an offer to borrow an application, in accordance with at least one embodiment.
Figure 7:
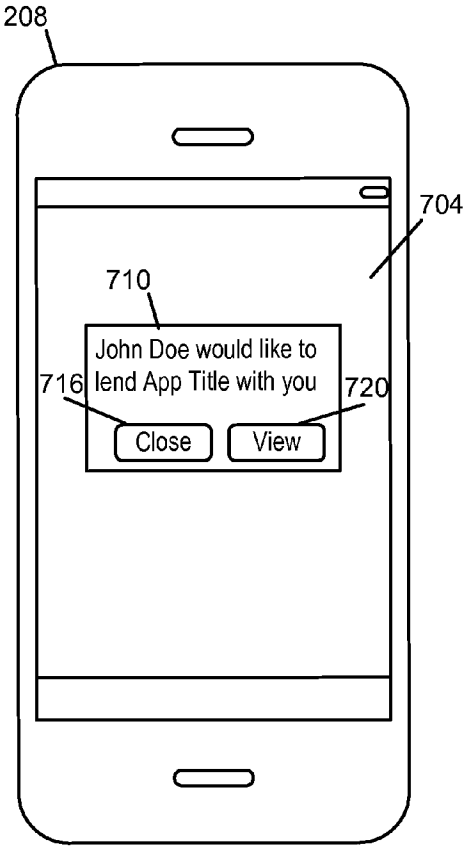
FIG. 7 is a schematic diagram illustrating an example user interface that displays a notice that someone would like to lend an application, in accordance with at least one embodiment.

FIG. 6 provides a flow diagram illustrating an example process 600 whereby the app-lend notification is received by the mobile device 208 of the borrowing user 204 and the application is downloaded from the application lending system 200 to the mobile device 208, in accordance with at least one embodiment. The process 600 will be described with reference to FIGS. 7 and 8. FIG. 7 is a schematic diagram illustrating an example user interface 704 that displayed on the mobile device 208 of the borrowing user 204 and gives notice that the lending user 202 would like to lend an application to the borrowing user, in accordance with at least one embodiment. FIG. 8 is a schematic diagram illustrating an example user interface 804 that prompts the borrowing user 204 to accept or decline an offer to borrow an application from the lending user 202, in accordance with at least one embodiment.

As indicated at 604, the process 600 generally begins by receiving an app-lend notification. Here, as described above, the mobile device 208 of the borrowing user 204 receives the app-lend notification directly from the mobile device 206 of the lending user 202 or from the mobile device 206 by way of the application lending system 200. At 610, the mobile device 208 presents notice of the app-lend notification to the borrowing user 204 and gives the borrowing user 204 the option of viewing details about the application and/or the offer to lend the application. For example, at 610, the mobile device 208 presents a popup window 710 via the interface 704. The popup window 710 indicates the name of the lending user 202 who sent the app-lend notification and the name of the application that is being offered. Further, the popup window 710 provides a "close" button 716 and a "view" button 720. If the borrowing user 204 selects the close button 716, then the app-lend notification is ignored, the popup window 710 disappears, and the mobile device 208 resumes normal operation. On the other hand, if the borrowing user 204 selects the view button 720, then the mobile device 208 provides the interface 804 of FIG. 8.

At 616, the mobile device 208 presents information about the application and the borrowing terms. For example, the interface 804 provides an icon 810 that represents the application and provides the title 816 and a description 820 of the application. The description 820 of the application may also describe the borrowing terms, such as how long the user can use the application without paying, what level of access the user can have during the trial period, whether the lending user is offering to sell or lend a stake/status in the application, etc. The interface 804 also provides an expiration date 824, which indicates the date on which the trial period for the application ends. At 622, the mobile device 208 gives the borrowing user 204 the option to decline the offer or accept the terms and download the application. For example, the interface 804 provides a "decline" button 830 and an "accept" button 834. If the borrowing user 204 selects the decline button 830, then the interface 804 disappears and the mobile device 208 resumes normal operation. On the other hand, if the borrowing user 204 selects the accept button 834, then, as indicated at 628, the mobile device 208 connects with the application lending system 200 pursuant to the information in the app-lend notification and downloads the application pursuant to the borrowing terms. It should be appreciated that, instead of downloading the application from the application lending system 200, the mobile device 208 could lend the application directly from the mobile device 206 of the lending user 202.

Figure 9:
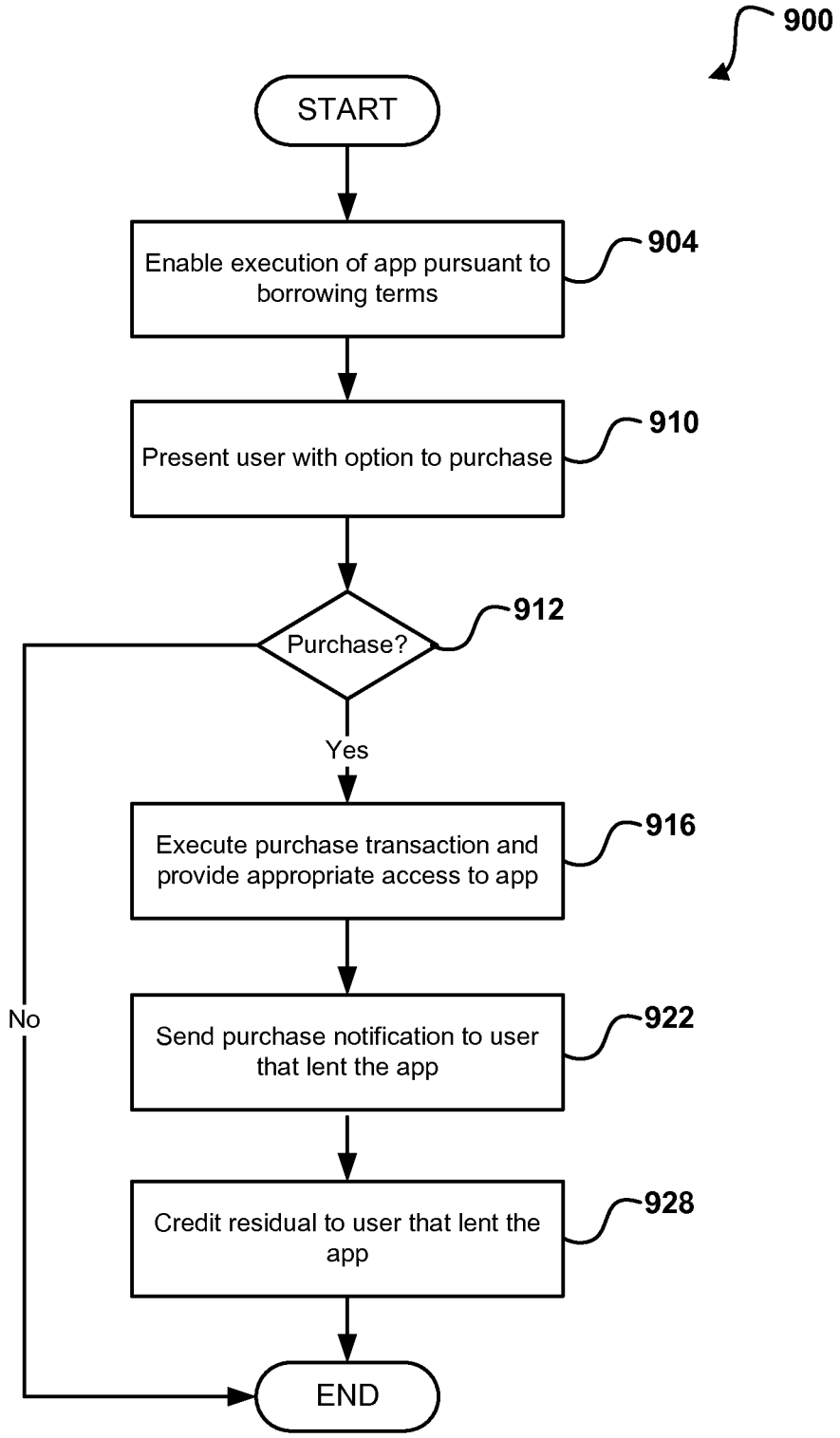
FIG. 9 provides a flow diagram illustrating an example process whereby a user is given an option to purchase an application and a commission is paid to a user that lent the application to the purchasing user, in accordance with at least one embodiment.
Figure 11:
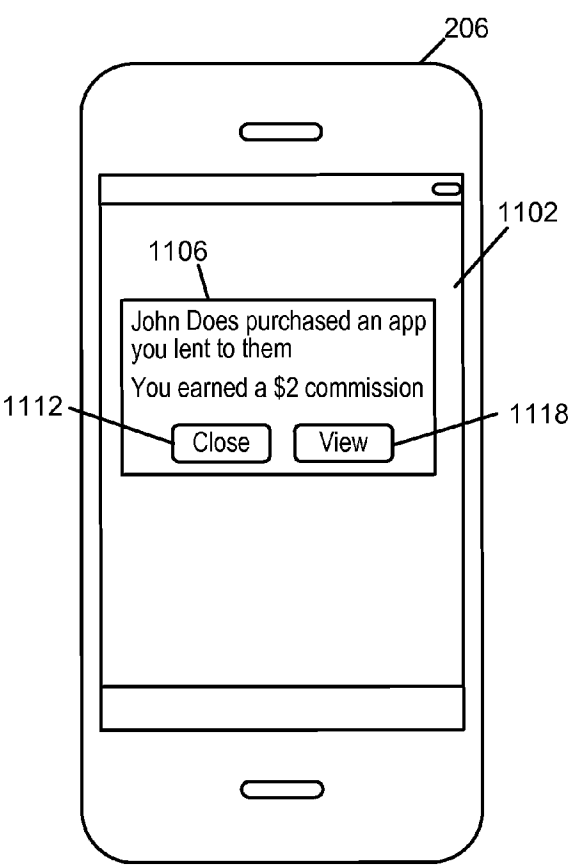
FIG. 11 is a schematic diagram illustrating an example user interface that gives notice that someone purchased an application that the user lent them, in accordance with at least one embodiment.
Figure 10:
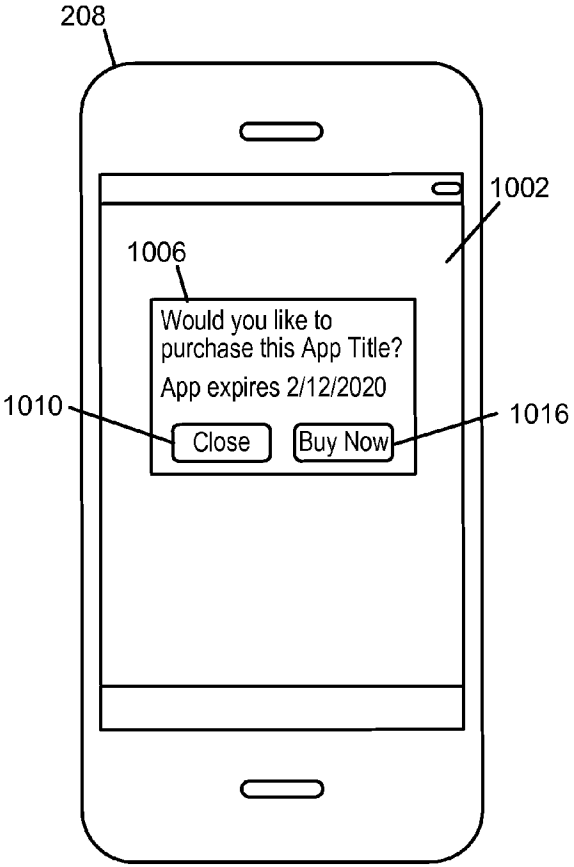
FIG. 10 is a schematic diagram illustrating an example user interface that prompts a user to purchase an application after the trial period of the application has ended, in accordance with at least one embodiment.

FIG. 9 provides a flow diagram illustrating an example process 900 whereby a borrowing user is given an option to purchase an application and a commission is paid to a lending user, in accordance with at least one embodiment. The process 900 will be described with reference to FIGS. 10 and 11. FIG. 10 is a schematic diagram illustrating an example user interface that prompts a user to purchase an application after the trial period for the application has ended, in accordance with at least one embodiment. FIG. 11 is a schematic diagram illustrating an example user interface that gives notice that a borrowing user has purchased an application that the lending user lent them, in accordance with at least one embodiment. As indicated at 904, the process 900 generally begins by enabling execution of the trial application pursuant to the borrowing terms. For example, the borrowing user 204 may use the application on the mobile 208 during the trial period. For example, the borrowing user 204 is able to execute the version of the application that was permitted to be borrowed, and the user may only access the permitted levels or features of the application.

At 910, the borrowing user 204 is presented with an option to purchase the application. For example, as illustrated in FIG. 10, the mobile device 208 displays a user interface 1002 having a popup window 1006 that indicates the expiration date of the trial period and asks the borrowing user 204 whether he would like to purchase the application. Further, the popup window 1006 provides a "close" button 1010 and a "buy now" button 1016. As indicated at 912, if the borrowing user does not purchase the application, then the process 900 ends. For example, if the borrowing user 204 selects the close button 1010, the popup window 1006 disappears and the mobile device 208 resumes normal operation. Also, as indicated at 912, if the borrowing user does purchase then the process 900 proceeds to 916, where the purchase transaction is executed and the borrowing user is given the appropriate access to the appropriate version of the application. For example, if the borrowing user 204 selects the view buy now 1016, a purchase transaction is executed. If the purchased version of the application is different than the trial version, the purchased version of the application is downloaded. It should be appreciated that the popup window 1006 may also provide information to the borrowing user 204 regarding whether the borrowing user may purchase the lending user's status or stake in the application, or any other type of data that the lending user 202 has that is relevant to the application. According to some embodiments, the popup window 1006 is provided to the borrowing user 204 each time the user launches the application, when the expiration date is approaching or has passed, at incremental time intervals, etc.

At 922 and 928, after the borrowing user purchases an application, a notification of the purchase is sent to the lending user 202 and, if applicable, the lending user is credited with the appropriate commission. For example, as illustrated in FIG. 11, the mobile device 206 of the lending user 202 displays a user interface 1102 having a popup window 1106 that indicates that the borrowing user purchased the application and, if applicable, indicates the commission earned by the lending user 202. The popup 1106 may display the name of the borrowing user. Further, the popup window 1106 provides a "close" button 1112 and a "view" button 1118. For example, if the lending user 202 selects the close button 1112, the popup window 1106 disappears and the mobile device 206 resumes normal operation. On the other hand, selects the view button 118 the user interface 1102 provides more information about the application and the commission.

Figure 12:
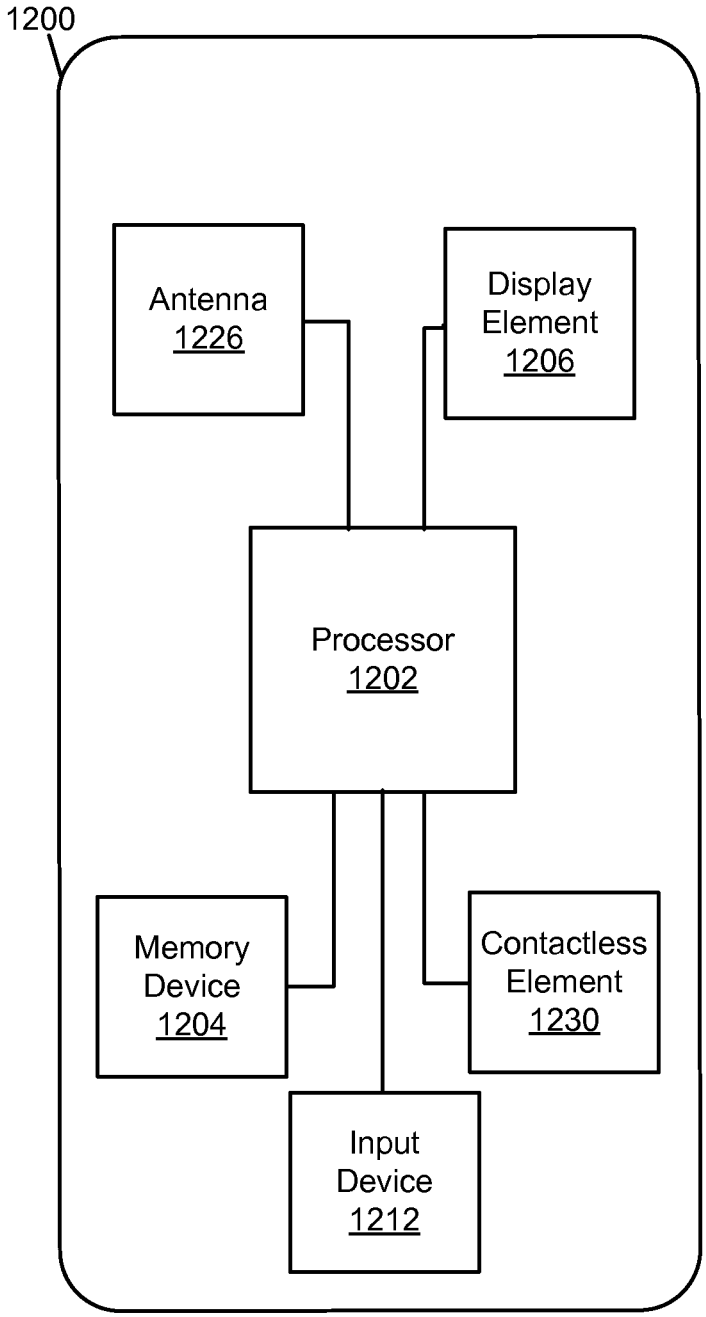
FIG. 12 shows an example mobile device, in accordance with at least one embodiment.

FIG. 12 illustrates a set of basic components of a mobile device 1200 such as the client device 104 described with respect to FIG. 1 and the mobile devices 206 and 208 described with respect to FIG. 2. In this example, the device includes at least one processor 1202 for executing instructions that can be stored in a memory device or element 1204. The instructions may include instructions related to sharing applications as described above. The device can include many types of memory, data storage or computer-readable media, such as a first data storage for program instructions for execution by the processor 1202, the same or separate storage that can be used for images or data, a removable memory that can be available for sharing information with other devices, and any number of communication approaches that can be available for sharing with other devices. The device typically will include at least one type of display element 1206, such as a touch screen, electronic ink (e-ink), organic light emitting diode (OLED) or liquid crystal display (LCD), although devices such as portable media players might convey information via other means, such as through audio speakers.

The device can include at least one additional input device 1212 able to receive conventional input from a user. This conventional input can include, for example, a push button, touch pad, touch screen, wheel, joystick, keyboard, mouse, trackball, keypad or any other such device or element whereby a user can input a command to the device. These I/O devices could even be connected by a wireless infrared or Bluetooth or other link as well in some embodiments. In some embodiments, however, such a device might not include any buttons at all and might be controlled only through a combination of visual and audio commands such that a user can control the device without having to be in contact with the device.

The device may further include a contactless element 1230, which is typically implemented in the form of a semiconductor chip (or other data storage element) with an associated wireless transfer (e.g., data transmission) element, such as an antenna. Data or control instructions transmitted via a cellular network may be applied to contactless element 1230 by means of a contactless element interface (not shown). The contactless element interface may function to permit the exchange of data and/or control instructions between the mobile device circuitry (and hence the cellular network) and an optional contactless element 1230.

Contactless element 1230 is capable of transferring and receiving data using a near field communications ("NFC") capability (or near field communications medium) typically in accordance with a standardized protocol or data transfer mechanism (e.g., ISO 14443/NFC). Near field communications capability is a short-range communications capability, such as RFID, Bluetooth™, infra-red, or other data transfer capability that can be used to exchange data between the mobile device and other mobile devices, such as between mobile devices 206 and 208. Thus, the mobile device is capable of communicating and transferring data and/or control instructions via both cellular network and near field communications capability. The mobile device may also include an antenna 1266 for wireless data transfer (e.g., data transmission).

The various embodiments further can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Most embodiments utilize at least one network that would be familiar to those skilled in the art for supporting communications using any of a variety of commercially-available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A computer-implemented method of lending an application, comprising:

receiving a lend request from a first user to lend an application that is installed on a first device of the first user to a second device of a second user, wherein the first user has a status in the application and the status unlocks one or more features in the application;

receiving a download request from the second user to download the application onto the second device;

creating a first offer for the second user to purchase the application without the status of the first user for use within the application;

creating a second offer for the second user to purchase the status of the first user for use within the application;

unlocking, using a computer processor, at least one of the features in the application using the status of the first user in response to at least receiving an indication that the second user purchased the status; and crediting the first user with commission in response to the second user purchasing the status of the first user.

2. The method of claim 1, wherein the application is configured to stop executing on the second device upon lapse of a trial period.

3. The method of claim 2, further comprising:

after the trial period lapses, prompting the second user to purchase the application; and crediting the first user with a commission if the second user purchases the application.

4. The method of claim 1, further comprising obtaining identification information associated with the second device.

5. The method of claim 4, further comprising using the identification information associated with the second device to send a lend notification to the second device, the lend notification indicating that the application is available for the second device to borrow.

6. The method of claim 5, wherein the identification information associated with the second device is obtained via near field communication.

7. The method of claim 5, wherein the identification information associated with the second device is a telephone number and the lend notification is sent to the second device via the telephone number.

8. The method of claim 5, wherein the identification information associated with the second device is an email address and the lend notification is sent to the second device via the email address.

9. A non-transitory computer-readable medium including instructions which when executed by a computer processor cause the computer processor to perform the following steps:

receiving a lend request from a first user to lend an application that is installed on a first device of the first user to a second device of a second user, wherein the first user has a status in the application and the status unlocks one or more features in the application;

receiving a download request from the second user to download the application onto the second device;

creating a first offer for the second user to purchase the application without the status of the first user for use within the application;

creating a second offer for the second user to purchase the status of the first user for use within the application;

unlocking, using a computer processor, at least one of the features in the application using the status of the first user in response to at least receiving an indication that the second user purchased the status; and crediting the first user with commission in response to the second user purchasing the status of the first user.

10. The non-transitory computer-readable medium of claim 9, wherein the application is configured to stop executing on the second device upon lapse of a trial period.

11. The non-transitory computer-readable medium of claim 10, wherein the instructions further cause the computer processor to perform additional steps of:

after the trial period lapses, prompting the second user to purchase the application; and crediting the first user with a commission if the second user purchases the application.

12. The non-transitory computer-readable medium of claim 9, wherein the instructions further cause the computer processor to perform additional steps of obtaining identification information associated with the second device.

13. The non-transitory computer-readable medium of claim 12, wherein the instructions further cause the computer processor to perform additional steps of using the identification information associated with the second device to send a lend notification to the second device, the lend notification indicating that the application is available for the second device to borrow.

14. The non-transitory computer-readable medium of claim 13, wherein the identification information associated with the second device is obtained via near field communication.

15. The non-transitory computer-readable medium of claim 13, wherein the identification information associated with the second device is a telephone number and the lend notification is sent to the second device via the telephone number.

16. The non-transitory computer-readable medium of claim 13, wherein the identification information associated with the second device is an email address and the lend notification is sent to the second device via the email address.

17. A system for lending an application, comprising:

a processor; and a memory device including instructions that, when executed by the processor, cause the processor to, at least:

receive a lend request from a first user to lend an application that is installed on a first device of the first user to a second device of a second user, wherein the first user has a status in the application and the status unlocks one or more features in the application;

receive a download request from the second user to download the application onto the second device;

create a first offer for the second user to purchase the application without the status of the first user for use within the application;

create a second offer for the second user to purchase the status of the first user for use within the application;

unlock, using a computer processor, at least one of the features in the application using the status of the first user in response to at least receiving an indication that the second user purchased the status; and credit the first user with commission in response to the second user purchasing the status of the first user.

18. The system of claim 17, wherein the application is configured to stop executing on the second device upon lapse of a trial period.

19. The system of claim 18, wherein the instructions further cause the processor to:

after the trial period lapses, prompting the second user to purchase the application; and crediting the first user with a commission if the second user purchases the application.

20. The system of claim 17, wherein the instructions further cause the processor to obtain identification information associated with the second device.

21. The system of claim 20, wherein the instructions further cause the processor to use the identification information associated with the second device to send a lend notification to the second device, the lend notification indicating that the application is available for the second device to borrow.

22. The system of claim 21, wherein the identification information associated with the second device is obtained via near field communication.

23. The system of claim 21, wherein the identification information associated with the second device is a telephone number and the lend notification is sent to the second device via the telephone number.

24. The system of claim 21, wherein the identification information associated with the second device is an email address and the lend notification is sent to the second device via the email address.

* * * * *